US008590063B2

(12) United States Patent
Aulenbach

(10) Patent No.: US 8,590,063 B2
(45) Date of Patent: Nov. 26, 2013

(54) ATHLETIC WEAR WITH REPLACEABLE INSERTS

(76) Inventor: Richard P Aulenbach, Wyomissing, PA (US)

( * ) Notice: Subject to any disclaimer, the term of this patent is extended or adjusted under 35 U.S.C. 154(b) by 54 days.

(21) Appl. No.: 13/287,361

(22) Filed: Nov. 2, 2011

(65) Prior Publication Data

US 2012/0102633 A1 May 3, 2012

Related U.S. Application Data

(60) Provisional application No. 61/409,239, filed on Nov. 2, 2010.

(51) Int. Cl.

| | |
|---|---|
| ***A41D 13/015*** | (2006.01) |
| *A41D 27/12* | (2006.01) |
| *A41D 27/26* | (2006.01) |

(52) U.S. Cl.

USPC ..... 2/267; 2/248; 2/456; 2/455

(58) Field of Classification Search

USPC ..... 2/455, 456, 458, 2.13, 459–467, 2.5, 2/411, 413, 92, 243.1, 247–253, 267, 272

See application file for complete search history.

(56) References Cited

U.S. PATENT DOCUMENTS

| | | | | | |
|---|---|---|---|---|---|
| 3,994,021 | A | * | 11/1976 | Villari et al. | 2/413 |
| 4,217,705 | A | * | 8/1980 | Donzis | 36/29 |
| 4,343,047 | A | * | 8/1982 | Lazowski et al. | 2/411 |
| 4,370,754 | A | * | 2/1983 | Donzis | 2/463 |
| 4,453,271 | A | * | 6/1984 | Donzis | 2/456 |
| 4,546,555 | A | * | 10/1985 | Spademan | 36/28 |
| 4,610,034 | A | * | 9/1986 | Johnson | 2/459 |
| 4,964,402 | A | * | 10/1990 | Grim et al. | 602/2 |
| 4,993,076 | A | * | 2/1991 | Dierickx | 2/463 |
| 5,025,575 | A | * | 6/1991 | Lakic | 36/44 |
| 5,121,962 | A | * | 6/1992 | Weber et al. | 297/214 |
| 5,228,143 | A | * | 7/1993 | Marchello | 2/425 |
| 5,228,253 | A | * | 7/1993 | Wattelez | 52/177 |
| 5,290,319 | A | * | 3/1994 | Phillips | 623/56 |
| 5,330,249 | A | * | 7/1994 | Weber et al. | 297/214 |
| 5,337,418 | A | * | 8/1994 | Kato et al. | 2/456 |
| 5,383,920 | A | * | 1/1995 | Sikes | 607/112 |
| 5,551,082 | A | * | 9/1996 | Stewart et al. | 2/465 |
| 5,717,997 | A | * | 2/1998 | Garcia | 2/23 |
| 5,840,397 | A | * | 11/1998 | Landi et al. | 428/73 |
| 5,881,395 | A | * | 3/1999 | Donzis | 2/455 |
| 5,918,309 | A | * | 7/1999 | Bachner, Jr. | 2/2.5 |
| 6,014,823 | A | * | 1/2000 | Lakic | 36/93 |
| 6,079,056 | A | * | 6/2000 | Fogelberg | 2/461 |
| 6,093,468 | A | * | 7/2000 | Toms et al. | 428/67 |
| 6,519,781 | B1 | * | 2/2003 | Berns | 2/267 |
| 6,560,789 | B2 | * | 5/2003 | Whalen et al. | 2/455 |
| 2001/0045104 | A1 | * | 11/2001 | Bailey et al. | 62/510 |
| 2002/0120980 | A1 | * | 9/2002 | Whalen et al. | 2/455 |
| 2002/0153009 | A1 | * | 10/2002 | Chornyj | 128/201.27 |
| 2003/0046747 | A1 | * | 3/2003 | Berns | 2/69 |
| 2003/0141333 | A1 | * | 7/2003 | Ammerman | 224/257 |
| 2005/0008669 | A1 | * | 1/2005 | Chen | 424/401 |
| 2005/0022422 | A1 | * | 2/2005 | Swigart et al. | 36/29 |

(Continued)

*Primary Examiner* — Bobby Muromoto, Jr.
(74) *Attorney, Agent, or Firm* — Gearhart Law, LLC

(57) ABSTRACT

An energy absorbing pad having a pouch that contains tubes that may be filled with flexible materials is described. The energy absorbing pad is worn as a part of an athletic wear garment so that it protects the wearer from injury due to impacts in contact sports.

19 Claims, 5 Drawing Sheets

(56) References Cited

U.S. PATENT DOCUMENTS

| | | | | |
|---|---|---|---|---|
| 2005/0081277 | A1* | 4/2005 | Matechen et al. | 2/102 |
| 2005/0251899 | A1* | 11/2005 | Dennis et al. | 2/414 |
| 2007/0074423 | A1* | 4/2007 | Goodwin et al. | 36/29 |
| 2007/0197949 | A1* | 8/2007 | Chen | 602/41 |
| 2007/0281125 | A1* | 12/2007 | Moore et al. | 428/71 |
| 2009/0100705 | A1* | 4/2009 | Cook et al. | 36/29 |
| 2009/0199431 | A1* | 8/2009 | Goodwin et al. | 36/29 |
| 2009/0307829 | A1* | 12/2009 | Onrot et al. | 2/465 |
| 2011/0056004 | A1* | 3/2011 | Landi | 2/459 |
| 2011/0138654 | A1* | 6/2011 | Cook et al. | 36/29 |
| 2011/0256346 | A1* | 10/2011 | Bowden et al. | 428/138 |
| 2011/0265239 | A1* | 11/2011 | Kanemitsu et al. | 2/19 |
| 2012/0000010 | A1* | 1/2012 | Moore et al. | 2/414 |
| 2012/0144988 | A1* | 6/2012 | Chen et al. | 89/36.02 |
| 2012/0174301 | A1* | 7/2012 | Onrot et al. | 2/465 |
| 2012/0297526 | A1* | 11/2012 | Leon | 2/413 |
| 2013/0000017 | A1* | 1/2013 | Szalkowski et al. | 2/414 |
| 2013/0000147 | A1* | 1/2013 | Goodwin et al. | 36/84 |

* cited by examiner

ATHLETIC WEAR WITH REPLACEABLE INSERTS

CLAIM OF PRIORITY

This application claims the priority of U.S. Ser. No. 61/409,239 filed on Nov. 2, 2010, which is incorporated herein by reference.

FIELD OF INVENTION

The invention relates to an energy absorbing pad and garment incorporating said energy absorbing pad. In particular, the present invention relates to an energy absorbing pad and garment adapted to absorb energy from an impact or fall incurred during the course of contact sports.

BACKGROUND

There is a need for a protection garment that allows the user to adjust for specific pad effectiveness for varying applications and thus provide protection from a range of impacts. The present invention overcomes or alleviates the disadvantages of existing protective garments.

SUMMARY OF INVENTION

The present invention is an energy absorbing pad, comprising a pouch suitable for use with a garment, having a front side, a back side, a first side, a second side, a top side and a bottom side; and disposed in said pouch at least one continuous fillable tube formed to be in a serpentine, linear, or spiral shape.

The energy absorbing pad is primarily for use during sports, particularly sports with physical contact, although other uses may be found. It may be such that a user may easily modify it to provide the desired level of protection and/or bulk. The energy absorbing pad may be used with a variety of sportswear garments, and by a variety of users of differing shapes and sizes.

It is an object of the invention to provide an energy absorbing pad that may be used with clothing for protection against impacts.

It is an object of the invention to provide an energy absorbing pad that may be easily modified for use during differing types of sports or activities.

It is an object of the invention to provide an energy absorbing pad that has a tube or multiple tubes.

It is an object of the invention to provide an energy absorbing pad that has a tube or multiple tubes that can be filled with and emptied of gases, liquids, gels, solids and mixtures thereof.

It is an object of the invention to provide a protective garment that permanently houses one or more energy absorbing pads.

It is an object of the invention to provide a protective garment that accommodates one or more energy absorbing pads in a removable fashion.

It is an object of the invention to provide an energy absorbing pad that can be used with a flak jacket, vest, hip guard, rib guard, shin guard, cup, or other athletic gear.

BRIEF DESCRIPTION OF DRAWINGS

Preferred embodiments of the invention will be further described with reference to the accompanying drawings by way of example only and without intending to be limiting, wherein.

DETAILED DESCRIPTION

Figure 1:
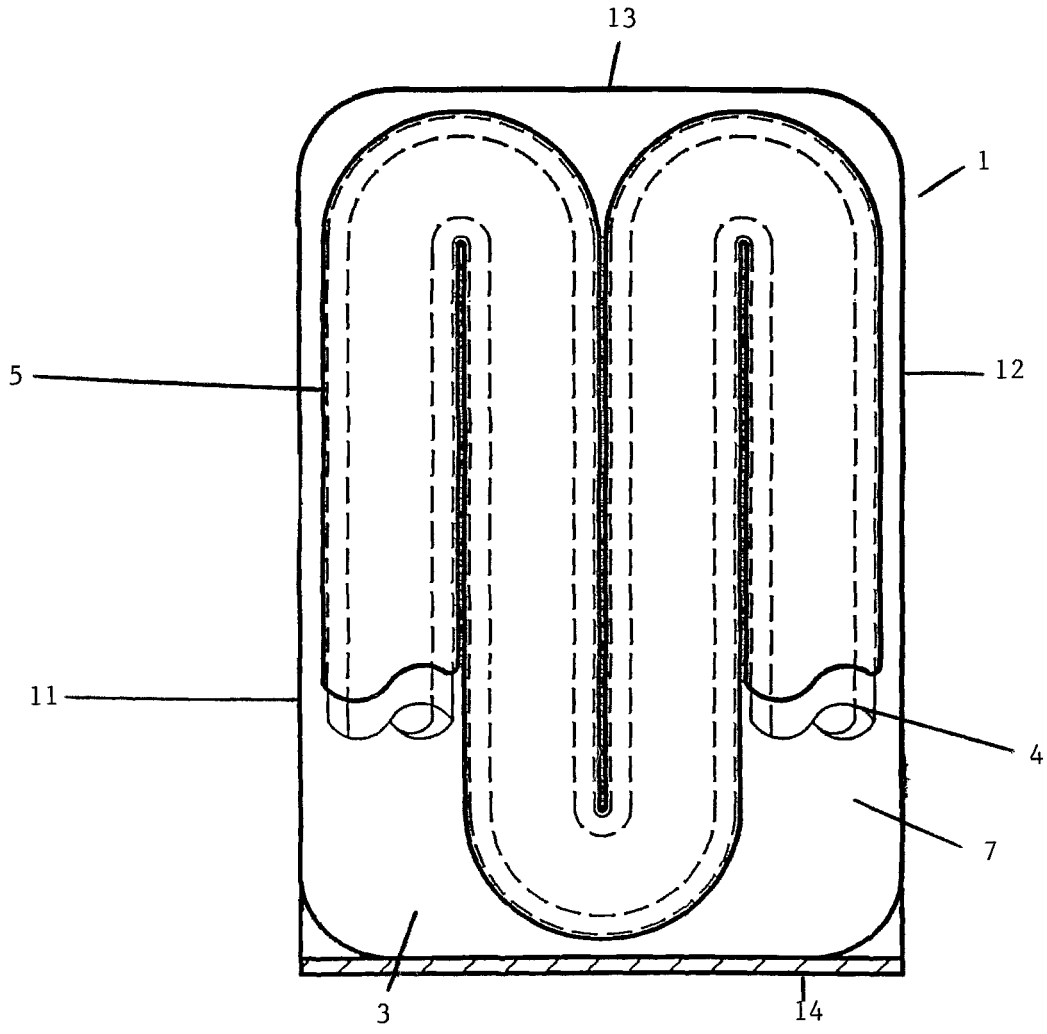
FIG. 1 is a front cut away view of an embodiment of an energy absorbing pad with a continuous fillable tube oriented in a serpentine pattern.

FIG. 1 is a front cut away view of an embodiment of an energy absorbing pad with a continuous fillable tube oriented in a serpentine pattern.

FIG. 1 shows the energy absorbing pad 1, with pouch 7 that has pouch back side 3, pouch first side 11, pouch second side 12, pouch top side 13, and pouch bottom side 14. Also shown is continuous fillable tube 4 covered by fabric tube cover 5 and oriented in a serpentine pattern. The pouch front side is not shown in FIG. 1 because it has been cut-away; the continuous fillable tube is disposed between the pouch front side and pouch back side. This is more clearly shown in FIGS. 4A-4C.

It is contemplated that the continuous fillable tube of the present invention can be formed of materials including but not limited to, elastic polymer, rubber, vinyl, plastic or polypropylene, polyethylene, polytetrafluoroethylene, fabrics, or other suitable materials known to one of skill in the art.

Preferably the continuous fillable tube is made of a resilient deformable material, so that when a user is wearing it in a garment, it deforms when impacted and is resilient so that it regains its approximate original form after impact. The continuous fillable tube may be constructed of rigid or semi-rigid material, so that it withstands an impact. The continuous fillable tube may be made from a combination of materials, such that the side facing the user is deformable and resilient, and the side facing the impact is rigid, or any other combination.

It is contemplated that the fabric tube cover may be constructed of materials including but not limited to nylon, polyester, poly-cotton blend, cotton or a sweat wicking fabric, e.g. fabrics of the type found in garments designated as an UNDERARMOUR® fabric, or other suitable fabric materials known to one of skill in the art.

It is contemplated that the pouch may be constructed preferably of fabric, including but not limited to, nylon, polyester, poly-cotton blend, cotton or a sweat wicking fabric, e.g. fabrics of the type found in garments designated as an UNDERARMOUR® fabric, or other suitable fabric materials known to one of skill in the art. It may also be constructed of other materials, including but not limited to, plastics, foam, metals, rubbers, fabric woven with metal, fiberglass, elastomers, graphene, waterproof materials, or any combination of these materials with each other or with other materials. The pouch may be made of a resilient deformable material, or of a rigid or semi-rigid material. The choice of material for the pouch depends on the type of garment in which its being used and the type of sport or other activity for which it's employed.

Figure 2:
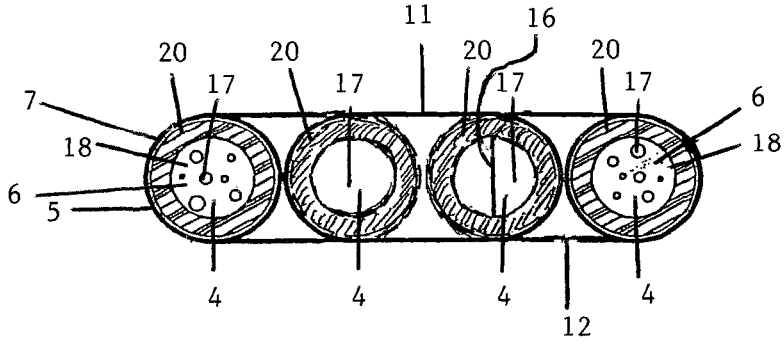
FIG. 2 shows a side cut-away view of a plurality of continuous fillable tubes in a pouch.

FIG. 2 shows a side cut-away view of a plurality of continuous fillable tubes in a pouch. FIG. 2 shows four separate continuous fillable tubes 4 with fillable tube walls 20 in a linear configuration inside the pouch 7, between pouch first side 11 and pouch second side 12. Two of the continuous fillable tubes contain gas impregnated gel 6, with gas 17 and gel 18. The other two contain gas 17 alone. The gas may be at ambient or elevated pressures; see FIG. 3 for further discussion. Also shown is continuous fillable tube thickness 16.

As can be seen in FIG. 2, a series of continuous fillable tubes may be filled with the same or differing substances, including but not limited to, gases, liquids, fluids, gels and/or solids, or any combination of these with each other or other substances. The preferred gas for the continuous fillable tubes is air, but it may be any gas, such as but not limited to, $CO_2$, $O_2$, $N_2$, or any type of gas. The gel liquids or fluids may be any type, including but not limited to, water, mineral oil, or any other liquid. The gel may be any type, including but not limited to, a silicone or polyacrylamide gel, hydrogel, organogel, or any other type of gel. The solids may be any solid, such as but not limited to, foam particles, plastics, rubbers, or any solid. The continuous fillable tubes may also be filled with combinations of these materials with themselves or each other, as in the figure where a gel is impregnated with a gas in two of the continuous fillable tubes.

A single continuous fillable tube may also be filled with more than one substance, either mixed as shown in the figure or in sections. For instance, one part of the continuous fillable tube may contain foam beading while another part contains a gel.

FIG. 2 shows the fillable tube wall 20, which is of a dimension and material that is strong enough to absorb an impact without breaking, approximately 0.00005 to 5 centimeters thick. It can be deformable and resilient, rigid, or semi-rigid. Inside the fillable tube wall 20 is the continuous fillable tube thickness, 16. This thickness is approximately between 0.0004 and 10 centimeters thick, and preferably between 0.04 and 2 centimeters thick.

Figure 3:
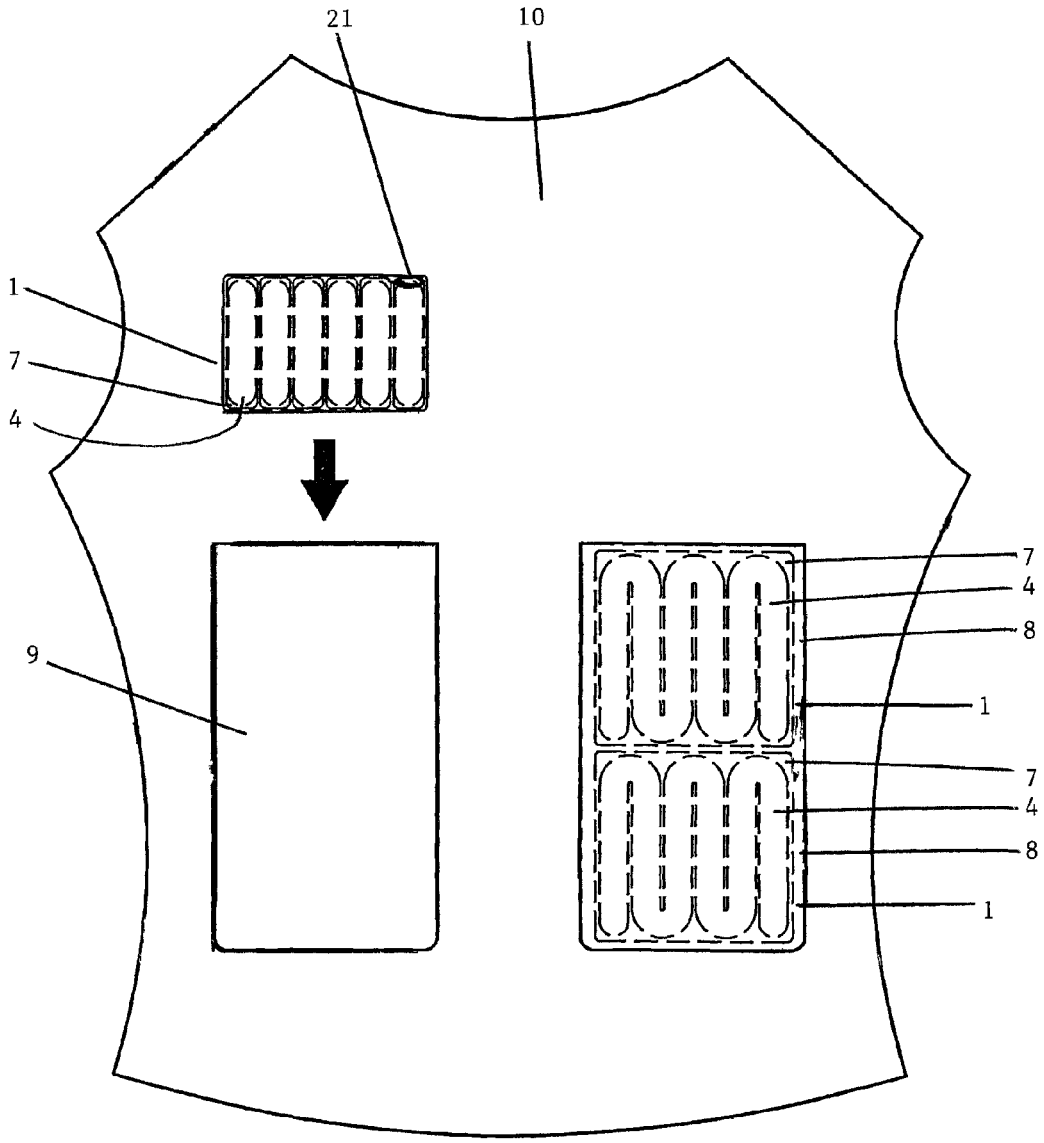
FIG. 3 is a front view of a garment and three energy absorbing pads, where two energy absorbing pads are permanently disposed in a sealed pad compartment and the other energy absorbing pad is configured to fit inside a pocket on the garment.

FIG. 3 is a front view of a garment and three energy absorbing pads, where two energy absorbing pads are permanently disposed in a sealed pad compartment in the garment and the other energy absorbing pad is configured to fit inside a pocket on the garment and to be removable. FIG. 3 shows energy absorbing pads 1, continuous fillable tubes 4, pouches 7, sealed pad compartment 8, pocket 9, garment 10, and valve receptor 21.

The garment may include a single or multiple energy absorbing pads 1 within the sealed pad compartment 8 or pocket 9 of the garment 10, and any combination thereof. The garment may be any garment, but is preferably a protective sports garment which may also have a single or multiple sealed pad compartments or pockets, and any combination thereof. The garment begins near the shoulder of a wearer and extends past the breastbone and ribcage of the wearer. Alternately, it may also extend down the back of the wearer to the buttocks of the wearer. The garment may be constructed of any fabric including, but not limited to, polyester, poly-cotton blend, cotton or a sweat wicking fabric, e.g. fabrics of the type found in garments designated as an UNDERARMOUR® fabric. As used herein, "suitable for use in a garment" means that the energy absorbing pad is of sufficient size to be disposed on a sleeve or pant leg or as a shoulder pad, helmet pad, chest pad, etc. The garment could be any garment but would likely be a pair of pants, shirt, jersey or vest or the like, shoe, helmet or glove.

It is contemplated that the energy absorbing pad may be removably and reconfigurably or permanently attached to the wearable garment via attachment methods including, but not limited to, stitching, adhesives, hook and loop fasteners, buttons, snaps, flange system, zipper or other suitable attachment methods known to one of skill in the art.

Optional Valve receptor 21 is used to adjust the content volume and/or pressure of the continuous fillable tubes. The valve receptor is configured to fit a valve that may be connected to a pump in order to pump gases, liquids or fluids, gels or solids into the continuous fillable tube. Alternately, the energy absorbing pad may be provided with an intermittent nozzle to allow a user to adjust a gas and gel combination. The tubes may also be prefilled and sealed by crimping, either by closing the end of the tube and sealing with heat or by crimping the end of the tube mechanically.

Figure 4A:
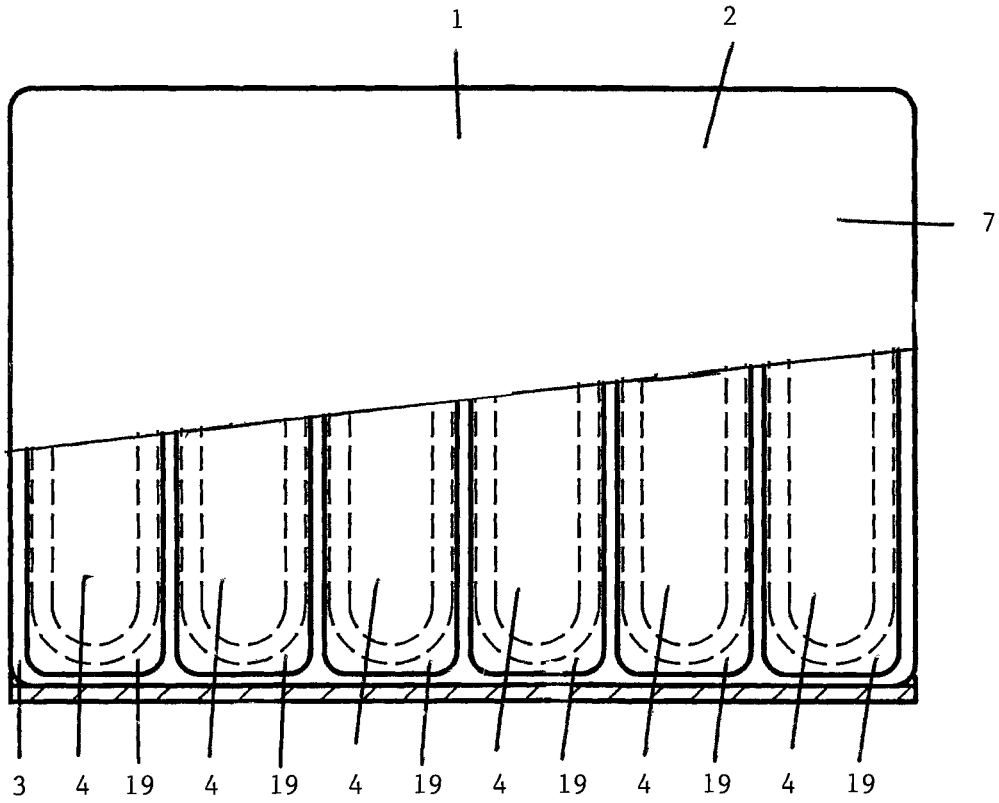
FIG. 4A is a partial cut-away view of an energy absorbing pad that depicts a plurality of continuous fillable tubes in a linear pattern housed between the pouch front side and the pouch back side.
Figure 4B:
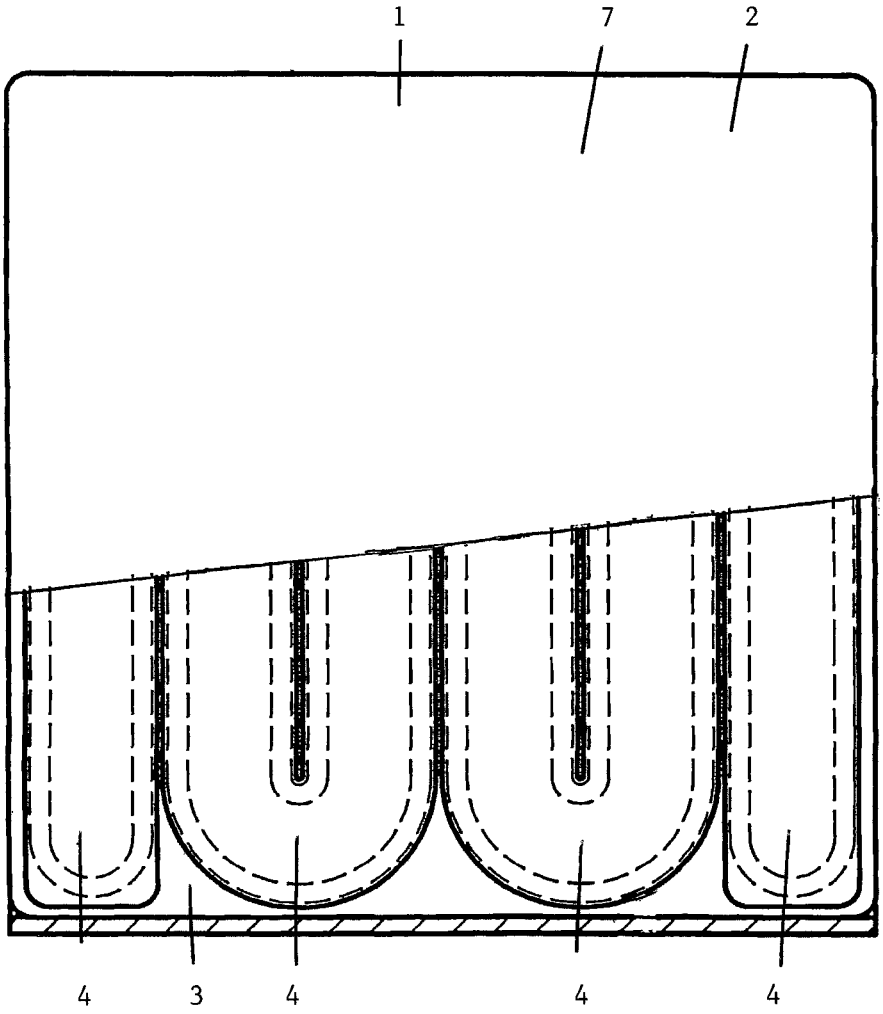
FIG. 4B is a partial cut-away view that depicts a continuous fillable tube in a serpentine pattern housed between the pouch front and back sides.
Figure 4C:
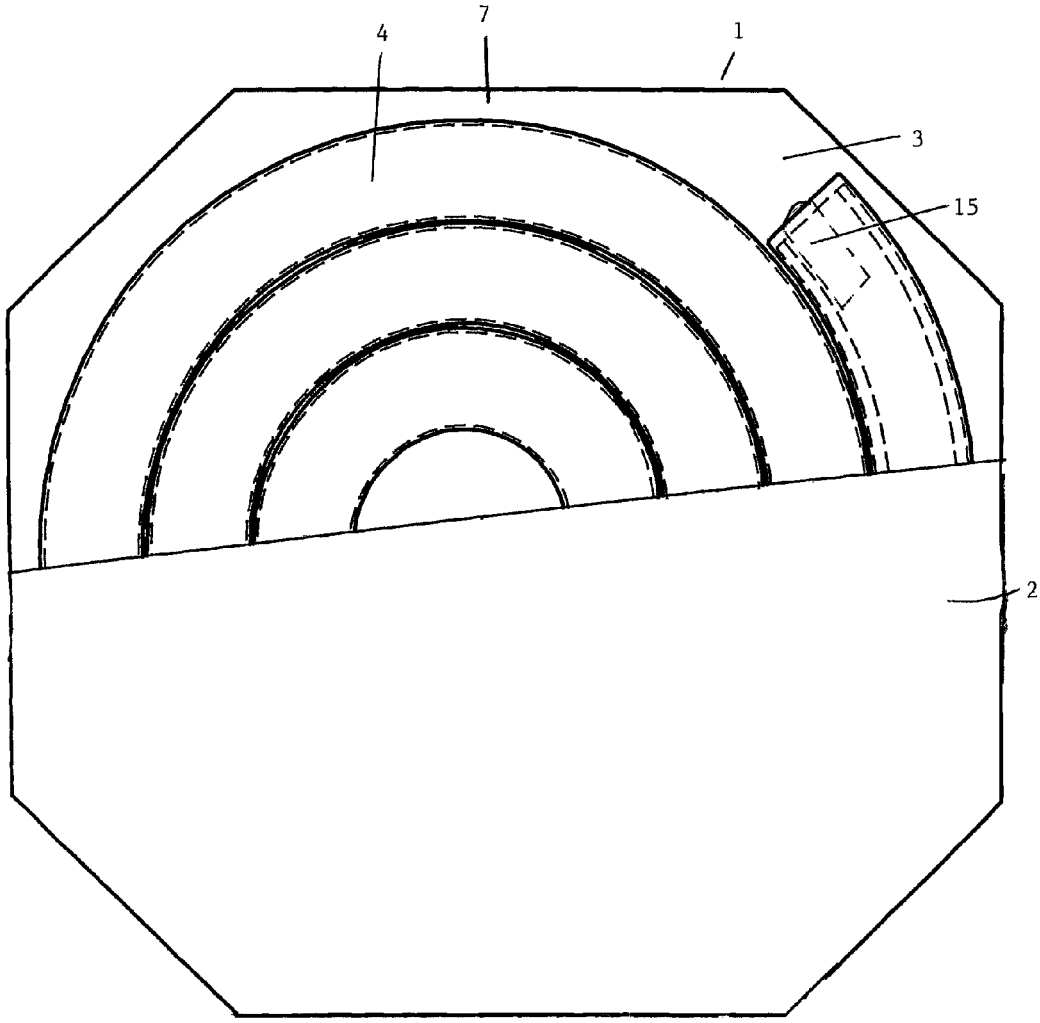
FIG. 4C is a partial cut-away view that depicts a continuous fillable tube in a circular pattern housed between the pouch front and back sides.

FIGS. 4A to 4C are partial cut away views of the invention, illustrating different configurations of the continuous fillable tube and how they are disposed in the pouch. As can be seen from the figures, the continuous fillable tube is removable from the pouch.

The pouch may be constructed such that it forces the continuous fillable tubes into a certain shape, or there may be a conformer device, such as but not limited to, a band or bands or a secondary container that conform the continuous fillable tubes into a serpentine, linear, or spiral shape.

Alternately, the continuous fillable tubes may be manufactured to conform to the desired shape without the aid of other devices.

FIG. 4A is a partial cut away view of the energy absorbing pad 1 showing a plurality of continuous fillable tubes in a linear pattern housed in the pouch 7. Shown are the pouch front side 2 and the pouch back side 3, with the continous fillable tubes 4 between the two sides. Each continuous fillable tube is in its own tube pocket 19; this allows flexibility as a user can add as many or as few continuous fillable tubes as he wants to the energy absorbing pad. For instance, the pad may contain six continuous fillable tubes for a large body part that needs covering, but the same pad could be used with only three continuous fillable tubes for a smaller body part. Alternately, the pad may contain six continuous fillable tubes when a large person uses it, but the same pad could be used with only three continuous fillable tubes for a smaller person. The tube pockets also help hold the continuous fillable tubes in the desired position in the energy absorbing pad. Although the plurality of continuous fillable tubes is illustrated in a linear shape in the figure, the continuous fillable tubes may be in any shape, including but not limited to, serpentine, linear, or spiral shapes, or any other desired shape. The continuous fillable tubes may all be the same shape in one energy absorbing pad, or they may be differing shapes.

FIG. 4B depicts one continuous fillable tube 4 in a serpentine pattern (similar to that shown in FIG. 1) housed in the pouch 7, between pouch front side 2 and pouch back side 3. The pouch is shown as flat and smooth in the figures, but it could follow the contours of the continuous fillable tube, either by its method of construction or through use. The pouch could also be made of plastic, foam or other material, such that it provides a stable cushioning of the continuous fillable tubes so that they don't move or twist.

FIG. 4C depicts an energy absorbing pad 1 with one continuous fillable tube 4 in a circular pattern housed in the pouch 7, between pouch front side 2 and pouch back side 3. FIG. 4C also depicts a valve 15; this valve can be retractable. The valve 15 is for adjusting and/or controlling pressure inside the continuous fillable tube. For instance, the continuous fillable tube may be filled with a liquid or gel and the user may want to introduce air to increase the pressure inside the continuous fillable tube. A nozzle could be attached and air could be pumped into the continuous fillable tube through the valve. If the continuous fillable tube is filled with an air or gas, the amount of gas could also be adjusted through the valve, for instance lowering the inner pressure if the user so desires.

The garment is designed to withstand impact forces such as those that occur in contact sports, for example, when a football player is tackled or a hockey player is checked by another player. When a wearer of the garment is subject to an impact, for example by being tackled during a football game, the energy absorbing pads of the garment absorb and spread the impact energy. If the impact is of sufficient force the energy absorbing pads of the garment may deform. The absorbing and spreading of energy protects the wearer from the full force of the impact. Therefore, the garment with energy absorbing pads disposed therein reduces and spreads the impact force felt by the wearer, thereby preventing an injury or reducing the severity of an injury.

It should be noted that the energy absorbing pad may vary in size and shape in a garment. The energy absorbing pad may also be arranged in different configurations in different garments.

The foregoing describes the invention including preferred forms thereof. Alterations and modifications as will be obvious to those skilled in the art are intended to be incorporated within the scope hereof as defined in the accompanying claims.

What is claimed is:

1. An energy-absorbing pad, comprising:

a pouch suitable for use with a garment, having a front side, a back side, a first side, a second side, a top side and a bottom side; and disposed in said pouch at least one continuous fillable tube formed to be in a serpentine shape or a spiral shape, and wherein, if in said serpentine shape, said tube is in a compact serpentine shape comprising:

a first straight section being adjacent to a second straight section and joined to it by a contiguous U-shaped section at an upper end of said first and second straight sections;

said second straight section being adjacent to a third straight section and joined to it by a contiguous U-shaped section at lower end of said second and third straight sections; and said third straight section being adjacent to a fourth straight section and joined to it by a contiguous U-shaped section at an upper end of said third and fourth straight sections;

and if in said spiral shape, said tube is in an Archimedean spiral shape having at least three complete turnings.

2. The article of claim 1 wherein the continuous fillable tube is removable from the pouch.

3. The article of claim 1 wherein the continuous fillable tube contains a gas, liquid, fluid, gel or solid, or mixtures thereof.

4. The article of claim 1 wherein the continuous fillable tube is filled to a pressure, and said pressure is controlled using a valve.

5. The article of claim 1, wherein the continuous fillable tube is conformed into a serpentine, linear or spiral shape by the pouch.

6. The article of claim 1, wherein the continuous fillable tube is conformed into a serpentine, linear or spiral shape by a conformer device.

7. The article of claim 1, wherein the continuous fillable tube is made of a resilient deformable material.

8. The article of claim 1, wherein the continuous fillable tube is made of a rigid or semi-rigid material.

9. The article of claim 1, wherein the thickness of the continuous fillable tube is between 0.0004 and ten centimeters.

10. The article of claim 1, wherein the thickness of the continuous fillable tube is between 0.04 and 2 centimeters.

11. The article of claim 1, wherein the pouch is made of a resilient deformable material.

12. The article of claim 1, wherein the pouch is made of a rigid or semi-rigid material.

13. The article of claim 1, wherein the pouch is made of plastic or foam.

14. The article of claim 1, wherein the energy absorbing pad is disposed in a garment.

15. The article of claim 14, wherein the garment is a protective sports garment.

16. The article of claim 15, wherein the energy absorbing pad is permanently disposed in said garment.

17. The article of claim 15, wherein the garment has a pocket and the energy absorbing pad is removably disposed in the pocket.

18. An energy absorbing pad, comprising: A pouch having a front side, a back side, a first side, a second side, a top side and a bottom side; and disposed in said pouch a plurality of continuous fillable tubes formed to be in a serpentine shape or a spiral shape, and wherein, if in said serpentine shape, said tube is in a compact serpentine shape comprising :

a first straight section being adjacent to a second straight section and joined to it by a contiguous U-shaped section at an upper end of said first and second straight sections;

said second straight section being adjacent to a third straight section and joined to it by a contiguous U-shaped section at lower end of said second and third straight sections; and said third straight section being adjacent to a fourth straight section and joined to it by a contiguous U-shaped section at an upper end of said third and fourth straight sections;

and if in said spiral shape, said tube is in an Archimedean spiral shape having at least three complete turnings.

19. The article of claim 18, wherein the pouch has a plurality of tube pockets to house the plurality of continuous fillable tubes.

* * * * *